US010808966B2

(12) United States Patent
Zha

(10) Patent No.: US 10,808,966 B2
(45) Date of Patent: Oct. 20, 2020

(54) COOLING SYSTEM WITH PARALLEL COMPRESSION

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 147 days.

(21) Appl. No.: 15/448,341

(22) Filed: Mar. 2, 2017

(65) Prior Publication Data

US 2018/0252442 A1 Sep. 6, 2018

(51) Int. Cl.
*F25B 5/02* (2006.01)
*F25B 43/00* (2006.01)
(Continued)

(52) U.S. Cl.
CPC ..... *F25B 5/02* (2013.01); *F25B 1/10* (2013.01); *F25B 31/002* (2013.01);
(Continued)

(58) Field of Classification Search
CPC .. F25B 5/02; F25B 1/10; F25B 43/006; F25B 49/02; F25B 31/002; F25B 2400/13;
(Continued)

(56) References Cited

U.S. PATENT DOCUMENTS 3,238,738 A * 3/1966 Webber ..... F25B 1/10 62/196.2
3,633,377 A * 1/1972 Quick ..... F25B 31/004 55/459.1
(Continued)

FOREIGN PATENT DOCUMENTS

DE 102014100917 A1 7/2015
DE 102015112439 A1 2/2017
(Continued)

OTHER PUBLICATIONS

CannnetENERGY. (Jul. 2009). Ejectors. Retrieved May 23, 2019, from https://www.nrcan.gc.ca/sites/www.nrcan.gc.ca/files/canmetenergy/files/2009-185_e.pdf (Year: 2009).*
(Continued)

*Primary Examiner* — Jianying C Atkisson
*Assistant Examiner* — Miguel A Diaz
(74) *Attorney, Agent, or Firm* — Baker Botts L.L.P.

(57) ABSTRACT

A system includes a high side heat exchanger, a first load, a second load, a third load, a first compressor, a second compressor, a third compressor, and a fourth compressor. The high side heat exchanger removes heat from a refrigerant. The first load uses the refrigerant to remove heat from a first space proximate the first load. The second load uses the refrigerant to remove heat from a second space proximate the second load. The third load uses the refrigerant to remove heat from a third space proximate the third load. The first compressor compresses the refrigerant from the first load. The second compressor compresses the refrigerant from the second load. The third compressor compresses the refrigerant from the third load and the refrigerant from the second compressor. The fourth compressor compresses the refrigerant from the first compressor.

15 Claims, 3 Drawing Sheets

(51) Int. Cl.

| | |
|---|---|
| ***F25B 31/00*** | (2006.01) |
| ***F25B 1/10*** | (2006.01) |
| ***F25B 49/02*** | (2006.01) |
| *F25B 9/00* | (2006.01) |

(52) U.S. Cl.
CPC ..... *F25B 43/006* (2013.01); *F25B 49/02* (2013.01); *F25B 9/008* (2013.01); *F25B 2341/0661* (2013.01); *F25B 2400/0401* (2013.01); *F25B 2400/0751* (2013.01); *F25B 2400/13* (2013.01); *F25B 2400/23* (2013.01); *F25B 2600/2501* (2013.01)

(58) Field of Classification Search
CPC ..... F25B 9/008; F25B 2341/0661; F25B 2400/0751; F25B 2400/0401; F25B 2600/2501; F25B 2400/23; F25B 2400/06; F25B 2400/075
See application file for complete search history.

(56) References Cited

U.S. PATENT DOCUMENTS

| | | | | |
|---|---|---|---|---|
| 4,916,914 | A * | 4/1990 | Short | C09K 5/045 252/68 |
| 8,056,356 | B2 * | 11/2011 | Javerschek | F25B 9/008 62/335 |
| 10,352,604 | B2 * | 7/2019 | Zha | F25B 1/10 |
| 2008/0110200 | A1 * | 5/2008 | Javerschek | F25B 9/008 62/515 |
| 2008/0307805 | A1 * | 12/2008 | Gupte | F25B 1/10 62/117 |
| 2013/0283833 | A1 * | 10/2013 | Huff | F25B 1/10 62/115 |
| 2013/0298593 | A1 * | 11/2013 | Christensen | F25B 9/008 62/467 |
| 2014/0326018 | A1 | 11/2014 | Ignatiev | |
| 2015/0345835 | A1 * | 12/2015 | Martin | F25B 7/00 62/238.3 |
| 2016/0138847 | A1 * | 5/2016 | Zimmermann | F25D 3/12 62/384 |
| 2016/0258662 | A1 * | 9/2016 | Zimmermann | F25B 49/022 |
| 2016/0363356 | A1 * | 12/2016 | Hinde | F25B 43/02 |
| 2017/0159977 | A1 * | 6/2017 | Hellmann | F25B 1/10 |
| 2017/0292767 | A1 * | 10/2017 | Douglas | F25B 13/00 |
| 2018/0156510 | A1 * | 6/2018 | Zha | F25B 49/02 |
| 2018/0195794 | A1 * | 7/2018 | Saunders | F25B 43/02 |
| 2018/0216851 | A1 * | 8/2018 | Christensen | F25B 5/00 |
| 2018/0231284 | A1 * | 8/2018 | Prins | F25B 49/02 |
| 2018/0274823 | A1 * | 9/2018 | Rajendiran | F25B 1/10 |
| 2018/0283754 | A1 * | 10/2018 | Prins | F25B 41/00 |
| 2019/0368786 | A1 * | 12/2019 | Newel | F25B 25/00 |

FOREIGN PATENT DOCUMENTS

| | | |
|---|---|---|
| EP | 3 064 866 A1 | 9/2016 |
| WO | WO 2017/023632 A1 | 2/2017 |

OTHER PUBLICATIONS

Communication from the European Patent Office re: Appl. No. 18154770.4-1005; Reference No. JL93022P.EPP, dated Jun. 4, 2018.

European Patent Office, Communication pursuant to Article 94(3) EPC, Application No. 18154770.4, dated Jul. 2, 2019, 5 pages.

European Patent Office, Communication pursuant to Article 94(3) EPC, Application No. 18154770.4, dated Apr. 15, 2020, 4 pages.

* cited by examiner

COOLING SYSTEM WITH PARALLEL COMPRESSION

TECHNICAL FIELD

This disclosure relates generally to a cooling system, specifically cooling system with parallel compression.

BACKGROUND

Cooling systems may cycle a refrigerant to cool various spaces. For example, a refrigeration system may cycle refrigerant to cool spaces near or around refrigeration loads.

SUMMARY OF THE DISCLOSURE

According to one embodiment, a system includes a high side heat exchanger, a first load, a second load, a third load, a first compressor, a second compressor, a third compressor, and a fourth compressor. The high side heat exchanger removes heat from a refrigerant. The first load uses the refrigerant to remove heat from a first space proximate the first load. The second load uses the refrigerant to remove heat from a second space proximate the second load. The third load uses the refrigerant to remove heat from a third space proximate the third load. The first compressor compresses the refrigerant from the first load. The second compressor compresses the refrigerant from the second load. The third compressor compresses the refrigerant from the third load and the refrigerant from the second compressor. The fourth compressor compresses the refrigerant from the first compressor.

According to another embodiment, a method includes removing heat from a refrigerant using a high side heat exchanger and removing heat from a first space proximate a first load using the refrigerant. The method also includes removing heat from a second space proximate a second load using the refrigerant and removing heat from a third space proximate a third load using the refrigerant. The method further includes compressing the refrigerant from the first load using a first compressor and compressing the refrigerant from the second load using a second compressor. The method also includes compressing the refrigerant from the third load and the refrigerant from the second compressor using a third compressor and compressing the refrigerant from the first compressor using a fourth compressor.

According to yet another embodiment, a system includes a first load, a second load, a third load, a first compressor, a second compressor, a third compressor, and a fourth compressor. The first load uses a refrigerant to remove heat from a first space proximate the first load. The second load uses the refrigerant to remove heat from a second space proximate the second load. The third load uses the refrigerant to remove heat from a third space proximate the third load. The first compressor compresses the refrigerant from the first load. The second compressor compresses the refrigerant from the second load. The third compressor compresses the refrigerant from the third load and the refrigerant from the second compressor. The fourth compressor compresses the refrigerant from the first compressor.

Certain embodiments may provide one or more technical advantages. For example, an embodiment improves the cooling efficiency of a cooling system by at least 5 to 10% compared to existing cooling systems. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
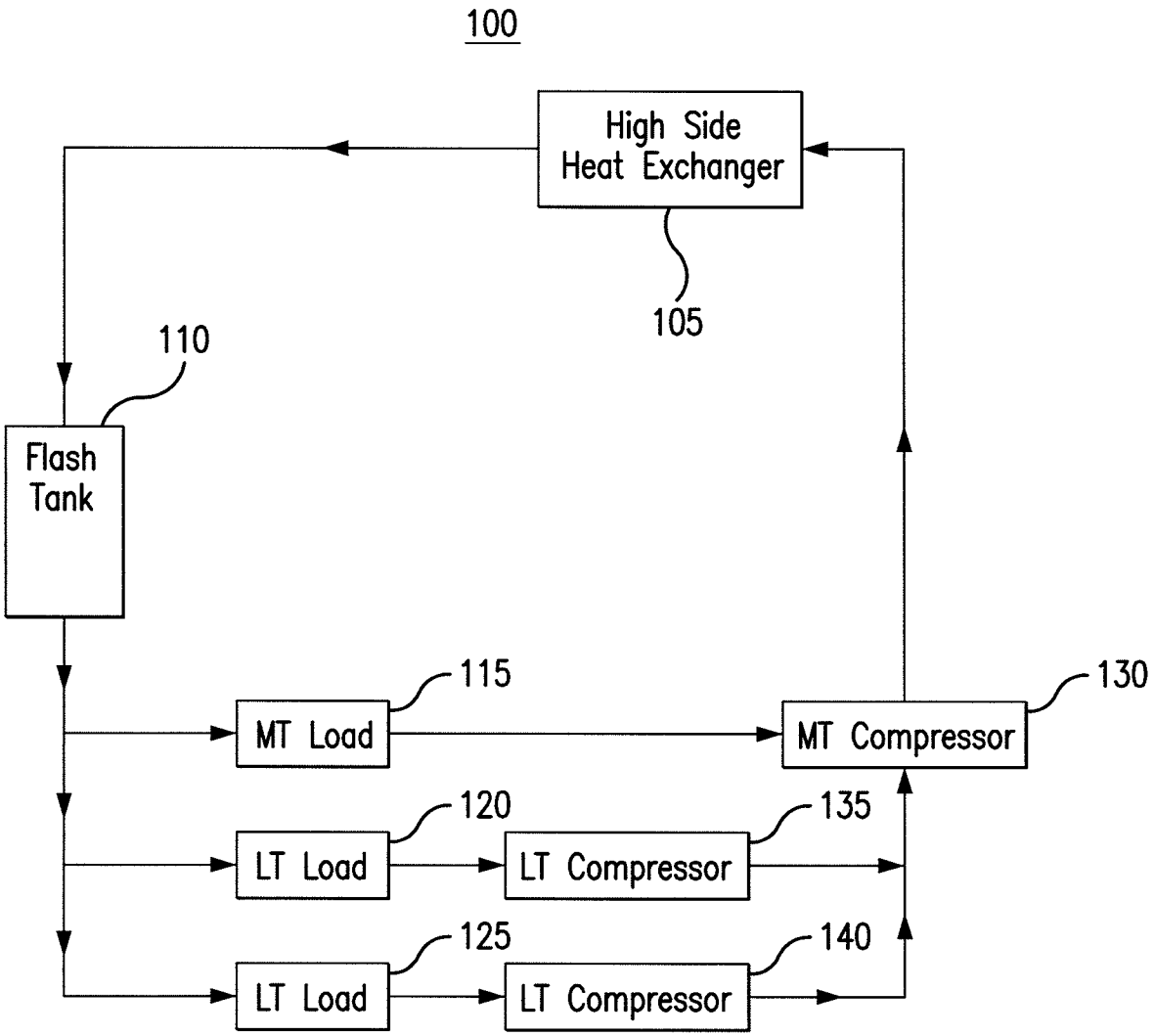
FIG. 1 illustrates an example cooling system.
Figure 2:
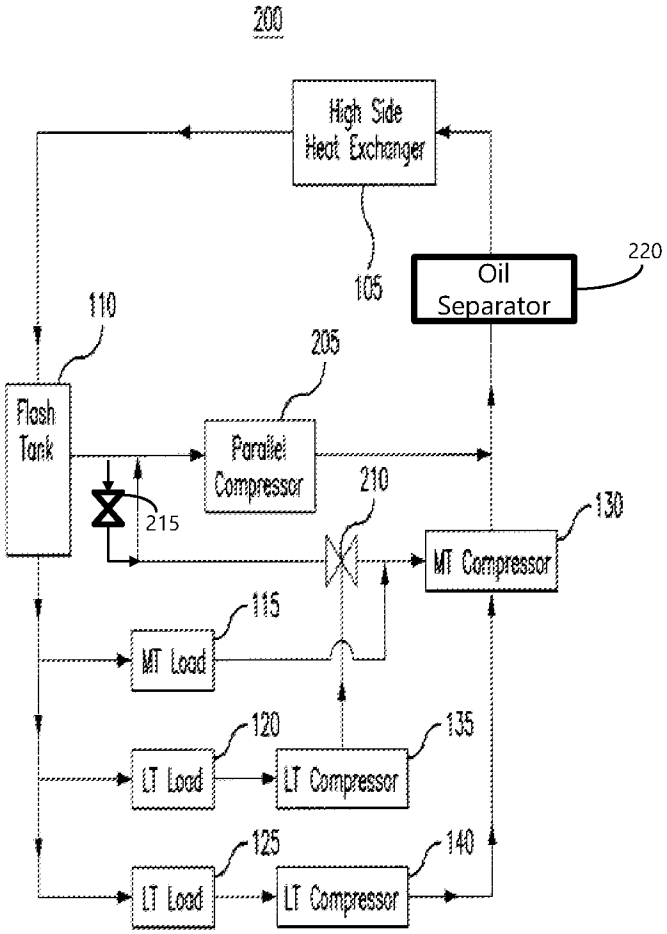
FIG. 2 illustrates an example cooling system.
Figure 3:
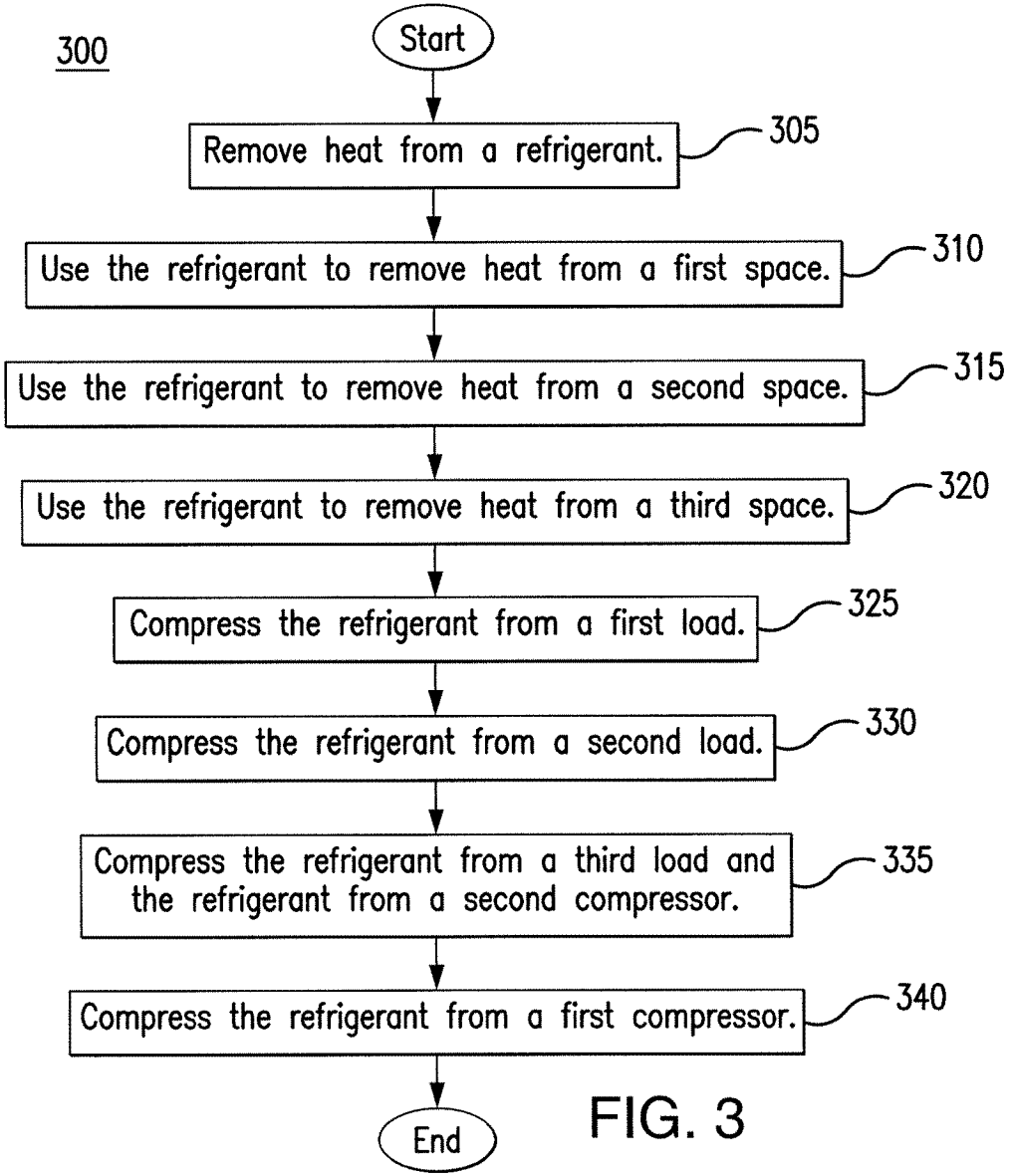
FIG. 3 is a flowchart illustrating a method of operating the example cooling system of FIG. 2.

Embodiments of the present disclosure and its advantages are best understood by referring to FIGS. 1 through 3 of the drawings, like numerals being used for like and corresponding parts of the various drawings.

Cooling systems may cycle a refrigerant to cool various spaces. For example, a refrigeration system may cycle refrigerant to cool spaces near or around refrigeration loads. In certain installations, such as at a grocery store for example, a refrigeration system may include different types of loads. For example, a grocery store may use medium temperature loads and low temperature loads. The medium temperature loads may be used for produce and the low temperature loads may be used for frozen foods. The compressors for these loads may be chained together. For example, the discharge of the low temperature compressor for the low temperature load may be fed into the medium temperature compressor that also compresses the refrigerant from the medium temperature loads. The discharge of the medium temperature compressor is then fed to a high side heat exchanger that removes heat from the compressed refrigerant.

When grocery stores want to expand their frozen food selection, grocery stores may add more low temperature loads, such as for example freezer cases, to the refrigeration system. Each additional low temperature load may be accompanied by an additional low temperature compressor. The discharge of each low temperature compressor may then be fed to the existing medium temperature compressor. As the number of low temperature loads increases so does the strain that is put on the medium temperature compressor. The more work the medium temperature compressor does, the lower the efficiency of the overall refrigeration system. The reduced efficiency may result in increased energy costs.

This disclosure contemplates a configuration of a refrigeration system that includes a parallel compressor that compresses the refrigerant from the low temperature compressors rather than the medium temperature compressor. This configuration may result in an improvement in the efficiency of the refrigeration system when additional low temperature loads are added to the refrigeration system. In some embodiments, the configuration may result in an efficiency gain of five to ten percent. In certain embodiments, the efficiency gain may be greater than ten percent. The system will be described in more detail using FIGS. 1 through 3. FIG. 1 will describe an existing refrigeration system. FIGS. 2 and 3 will describe the refrigeration system with parallel compression.

FIG. 1 illustrates an example cooling system 100. As shown in FIG. 1, system 100 includes a high side heat exchanger 105, a flash tank 110, a medium temperature load 115, a low temperature load 120, a low temperature load 125, a medium temperature compressor 130, a low temperature compressor 135, and a low temperature compressor 140.

High side heat exchanger 105 may remove heat from a refrigerant. When heat is removed from the refrigerant, the refrigerant is cooled. This disclosure contemplates high side heat exchanger 105 being operated as a condenser, a fluid cooler, and/or a gas cooler. When operating as a condenser, high side heat exchanger 105 cools the refrigerant such that the state of the refrigerant changes from a gas to a liquid. When operating as a fluid cooler, high side heat exchanger 105 cools liquid refrigerant and the refrigerant remains a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Flash tank 110 may store refrigerant received from high side heat exchanger 105. This disclosure contemplates flash tank 110 storing refrigerant in any state such as, for example, a liquid state and/or a gaseous state. Refrigerant leaving flash tank 110 is fed to low temperature load 120, low temperature load 125, and medium temperature load 115. In some embodiments, a flash gas and/or a gaseous refrigerant is released from flash tank 110. By releasing flash gas, the pressure within flash tank 110 may be reduced.

System 100 may include a low temperature portion and a medium temperature portion. The low temperature portion may operate at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant may flow from flash tank 110 to both the low temperature and medium temperature portions of the refrigeration system. For example, the refrigerant may flow to low temperature load 120, low temperature load 125, and medium temperature load 115. When the refrigerant reaches low temperature load 120, low temperature load 125, or medium temperature load 115, the refrigerant removes heat from the air around low temperature load 120, low temperature load 125, or medium temperature load 115. As a result, the air is cooled. The cooled air may then be circulated such as, for example, by a fan to cool a space such as, for example, a freezer and/or a refrigerated shelf. As refrigerant passes through low temperature load 120, low temperature load, 125, and medium temperature load 115, the refrigerant may change from a liquid state to a gaseous state as it absorbs heat.

Refrigerant may flow from low temperature load 120, low temperature load 125, and medium temperature load 115 to compressors 130, 135, and 140. This disclosure contemplates system 100 including any number of low temperature compressors 135, 140 and medium temperature compressors 130. The low temperature compressors 135, 140 and medium temperature compressor 130 may be configured to increase the pressure of the refrigerant. As a result, the heat in the refrigerant may become concentrated and the refrigerant may become a high pressure gas. Low temperature compressor 135 may compress refrigerant from low temperature load 120 and send the compressed refrigerant to medium temperature compressor 130. Low temperature compressor 140 may compress refrigerant from low temperature load 125 and send the compressed refrigerant to medium temperature compressor 130. Medium temperature compressor 130 may compress refrigerant from low temperature compressors 135 and 140 and medium temperature load 115. Medium temperature compressor 130 may then send the compressed refrigerant to high side heat exchanger 105.

As shown in FIG. 100, the discharges of low temperature compressor 135 and low temperature compressor 140 are fed to medium temperature compressor 130. Medium temperature compressor 130 then compresses the refrigerant from medium temperature load 115, low temperature compressor 135, and low temperature compressor 140. As additional low temperature loads and/or low temperature compressors are added to system 100, the strain on medium temperature compressor 130 increases. As medium temperature compressor 130 does more work, the overall efficiency of system 100 falls. As a result of the reduced efficiency, operating system 100 may result in increased energy costs.

FIG. 2 illustrates an example cooling system 200. As shown in FIG. 2, system 200 includes a high side heat exchanger 105, a flash tank 110, a medium temperature load 115, a low temperature load 120, a low temperature load 125, a medium temperature compressor 130, a low temperature compressor 135, a low temperature compressor 140, a parallel compressor 205, and a valve 210. System 200 includes several components that are also in system 100. These components operate similarly as they did in system 100. In particular embodiments, system 200 improves the efficiency of medium temperature compressor 130 over system 100. As a result, system 200 may reduce energy costs compared to system 100.

The primary difference between system 200 and system 100 is the use of parallel compressor 205. In system 200, the discharge of low temperature compressor 135 is fed to parallel compressor 205 instead of medium temperature compressor 130. Parallel compressor 205 also compresses a flash gas from flash tank 110. By using parallel compressor 205, the amount of work that medium temperature 130 does is reduced. In certain embodiments, system 200 may see at least a five to ten percent efficiency gain over system 100.

Valve 210 controls where the discharge of low temperature compressor 135 goes. For example, valve 210 may direct the discharge of low temperature compressor 135 to parallel compressor 205. As another example, valve 210 may direct the discharge of low temperature compressor 135 to medium temperature compressor 130. In this manner, the strain on parallel compressor 205 and medium temperature compressor 130 may be adjusted using valve 210. In particular embodiments, valve 210 is a three-way valve. For example, valve 210 may receive refrigerant from low temperature compressor 135 and direct the refrigerant either to parallel compressor 205 or medium temperature compressor 130, or to both.

On occasion, parallel compressor 205 may be turned off for various reasons such as, for example, maintenance. When parallel compressor 205 is turned off, valve 210 may be adjusted to direct the refrigerant from low temperature compressor 135 to medium temperature compressor 130. When maintenance is complete and parallel compressor 205 is turned back on, valve 210 may be adjusted to direct the refrigerant from low temperature compressor 135 back to parallel compressor 205.

In certain embodiments, system 200 includes a valve that directs flash gas from flash tank 110 to medium temperature compressor 130 when parallel compressor 205 is turned off. For example, if parallel compressor 205 is undergoing maintenance, then the valve may be adjusted to direct flash gas from flash tank 110 to medium temperature compressor 130. When maintenance is complete, the valve may be adjusted again to direct flash gas from flash tank 110 to parallel compressor 205.

In certain embodiments, medium temperature load 115 may be at a higher temperature than low temperature load 120 and low temperature load 125. Furthermore, low temperature load 125 may be at a lower temperature than low temperature load 120. This disclosure contemplates medium temperature load 115, low temperature load 120, and low temperature load 125 operating at any temperature relative to each other.

In particular embodiments, system 200 includes an oil separator before high side heat exchanger 105. The oil separator may separate oils from the refrigerant from medium temperature compressor 130 and parallel compressor 205. By separating the oil from the refrigerant, it may be easier for high side heat exchanger 105 to remove heat from the refrigerant. Additionally, separating oil from the refrigerant may increase the lifetime and/or efficiency of other components of system 200. The oil separator may separate the oil from the refrigerant and send the refrigerant to high side heat exchanger 105.

This disclosure contemplates system 200 including any number of components. For example, system 200 may include any number of low temperature loads, medium temperature loads, and air conditioning loads. As another example, system 200 may include any number of low temperature compressors, medium temperature compressors, and parallel compressors. As yet another example, system 200 may include any number of high side heat exchangers 105 and flash tanks 110. This disclosure also contemplates cooling system 200 using any appropriate refrigerant. For example, cooling system 200 may use a carbon dioxide refrigerant.

FIG. 3 is a flowchart illustrating a method 300 of operating the example cooling system 200 of FIG. 2. Various components of system 200 perform the steps of method 300. In certain embodiments, performing method 300 may improve the efficiency of a cooling system by at least five to ten percent.

High side heat exchanger 105 begins by removing heat from a refrigerant in step 305. In step 310, low temperature load 120 removes heat from a first space using the refrigerant. In step 315, low temperature load 125 removes heat from a second space using the refrigerant. In step 320, medium temperature load 115 removes heat from a third space using the refrigerant. In step 325, low temperature compressor 135 compresses refrigerant from low temperature load 120. In step 330, low temperature compressor 140 compresses refrigerant from low temperature load 125. Medium temperature compressor 130 compresses refrigerant from medium temperature load 115 and low temperature compressor 140 in step 335. In step 340, parallel compressor 205 compresses refrigerant from low temperature compressor 135.

Modifications, additions, or omissions may be made to method 300 depicted in FIG. 3. Method 300 may include more, fewer, or other steps. For example, steps may be performed in parallel or in any suitable order. While discussed as various components of cooling system 200 performing the steps, any suitable component or combination of components of system 200 may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a high side heat exchanger configured to remove heat from a refrigerant;

a flash tank configured to store the refrigerant from the high side heat exchanger, the flash tank configured to discharge a flash gas;

a first load configured to use the refrigerant to remove heat from a first space proximate the first load;

a second load configured to use the refrigerant to remove heat from a second space proximate the second load;

a third load configured to use the refrigerant to remove heat from a third space proximate the third load;

a first compressor configured to compress the refrigerant from the first load;

a second compressor configured to compress the refrigerant from the second load;

a third compressor configured to compress the refrigerant from the third load and the refrigerant from the second compressor before the refrigerant from the third load and the refrigerant from the second compressor returns to the high side heat exchanger;

a first valve; and a fourth compressor, when the fourth compressor is on:

the first valve is configured to direct the refrigerant from the first compressor to the fourth compressor, before the refrigerant from the first compressor returns to the high side heat exchanger, and away from the third compressor; and the fourth compressor is configured to compress the refrigerant from the first compressor and the flash gas;

when the fourth compressor is off:

the first valve is configured to direct the refrigerant from the first compressor to the third compressor, before the refrigerant from the first compressor returns to the high side heat exchanger, and away from the fourth compressor; and the third compressor is further configured to compress the refrigerant from the first compressor and the flash gas.

2. The system of claim 1, further comprising a second valve configured to direct the flash gas to the third compressor when the fourth compressor is turned off.

3. The system of claim 1, wherein the first valve is a three-way valve.

4. The system of claim 1, wherein:

the third load maintains the third space at a higher temperature than both the first space and the second space; and the second load maintains the second space at a lower temperature than the first space.

5. The system of claim 1, further comprising an oil separator configured to:

receive the refrigerant from the third compressor and the fourth compressor; and send the refrigerant to the high side heat exchanger.

6. A method comprising:

removing heat from a refrigerant using a high side heat exchanger;

storing the refrigerant from the high side heat exchanger using a flash tank;

discharging a flash gas from the flash tank;

removing heat from a first space proximate a first load using the refrigerant;

removing heat from a second space proximate a second load using the refrigerant;

removing heat from a third space proximate a third load using the refrigerant;

compressing the refrigerant from the first load using a first compressor;

compressing the refrigerant from the second load using a second compressor;

compressing the refrigerant from the third load and the refrigerant from the second compressor before the refrigerant from the third load and the refrigerant from the second compressor returns to the high side heat exchanger using a third compressor;

turning on a fourth compressor, and when the fourth compressor is on:

directing, by a first valve, the refrigerant from the first compressor to the fourth compressor, before the refrigerant from the first compressor returns to the high side heat exchanger, and away from the third compressor; and compressing the refrigerant from the first compressor and the flash gas using the fourth compressor;

turning off the fourth compressor, and when the fourth compressor is off:

directing, by the first valve, the refrigerant from the first compressor to the third compressor, before the refrigerant from the first compressor returns to the high side heat exchanger, and away from the fourth compressor; and compressing, by the third compressor, the refrigerant from the first compressor and the flash gas.

7. The method of claim 6, further comprising:

directing, by a second valve, the flash gas to the third compressor when the fourth compressor is turned off.

8. The method of claim 7, wherein the first valve is a three-way valve.

9. The method of claim 6, further comprising:

maintaining, by the third load, the third space at a higher temperature than both the first space and the second space; and maintaining, by the second load, the second space at a lower temperature than the first space.

10. The method of claim 6, further comprising:

receiving the refrigerant from the third compressor and the fourth compressor at an oil separator; and sending the refrigerant to the high side heat exchanger.

11. A system comprising:

a flash tank configured to store a refrigerant and to discharge a flash gas;

a first load configured to use the refrigerant to remove heat from a first space proximate the first load;

a second load configured to use the refrigerant to remove heat from a second space proximate the second load;

a third load configured to use the refrigerant to remove heat from a third space proximate the third load;

a first compressor configured to compress the refrigerant from the first load;

a second compressor configured to compress the refrigerant from the second load;

a third compressor configured to compress the refrigerant from the third load and the refrigerant from the second compressor before the refrigerant from the third load and the refrigerant from the second compressor returns to the flash tank;

a first valve; and a fourth compressor, when the fourth compressor is on:

the first valve is configured to direct the refrigerant from the first compressor to the fourth compressor, before the refrigerant from the first compressor returns to the high side heat exchanger, and away from the third compressor; and the fourth compressor is configured to compress the refrigerant from the first compressor and the flash gas;

when the fourth compressor is off:

the first valve is configured to direct the refrigerant from the first compressor to the third compressor, before the refrigerant from the first compressor returns to the high side heat exchanger, and away from the fourth compressor; and the third compressor is further configured to compress the refrigerant from the first compressor and the flash gas.

12. The system of claim 11, further comprising a second valve configured to direct the flash gas to the third compressor when the fourth compressor is turned off.

13. The system of claim 12, wherein the first valve is a three-way valve.

14. The system of claim 11, wherein:

the third load maintains the third space at a higher temperature than both the first space and the second space; and the second load maintains the second space at a lower temperature than the first space.

15. The system of claim 11, further comprising an oil separator configured to:

receive the refrigerant from the third compressor and the fourth compressor; and send the refrigerant to a high side heat exchanger.

* * * * *